United States Patent [19]

Johnson, Jr.

[11] Patent Number: 4,686,412

[45] Date of Patent: Aug. 11, 1987

[54] REFLECTOR-TYPE LAMP HAVING REDUCED FOCUS LOSS

[75] Inventor: Pierce Johnson, Jr., Topsfield, Mass.

[73] Assignee: GTE Products Corporation, Danvers, Mass.

[21] Appl. No.: 852,002

[22] Filed: Apr. 14, 1986

[51] Int. Cl.[4] ..... H01J 1/16; H01J 19/10; H01K 1/14

[52] U.S. Cl. ..... 313/344; 313/113; 313/341; 313/315; 315/71; 445/48

[58] Field of Search ..... 313/315, 341, 344, 113; 315/71; 445/35, 48

[56] References Cited

U.S. PATENT DOCUMENTS

| | | | |
|---|---|---|---|
| 2,218,345 | 10/1940 | Spaeth | 313/344 |
| 2,424,518 | 7/1947 | Stuart | 313/344 |
| 3,942,063 | 3/1976 | Winter et al. | 313/315 |
| 4,208,609 | 6/1980 | Berlec | 313/315 |
| 4,316,116 | 2/1982 | Graves et al. | 313/344 |
| 4,461,973 | 7/1984 | Kaufman et al. | 315/56 |
| 4,480,212 | 10/1984 | Monaham et al. | 315/71 |
| 4,499,401 | 2/1985 | Graves et al. | 313/315 |
| 4,547,704 | 10/1985 | Brinn et al. | 315/71 |

*Primary Examiner*—Saxfield Chatmon

*Attorney, Agent, or Firm*—Jose' W. Jimenez; Joseph S. Romanow

[57] ABSTRACT

This invention provides for an improved reflector-type lamp having reduced focus loss and exhibiting an increase in reflector collection efficiency. Stray light from the lamp's light source is reduced and channeled into the central angular region of the reflector where it can be more easily controlled and increase the in candle power of the lamp. A shorter, more compact filament design, wound with larger mandrel ratios, is positioned within the reflector to evenly disperse the light energy throughout the central angular region.

14 Claims, 8 Drawing Figures

REFLECTOR-TYPE LAMP HAVING REDUCED FOCUS LOSS

CROSS REFERENCES TO COPENDING APPLICATIONS

Application Ser. No. 852,010 entitled "Compact Incandescent Coiled Coil Filament" (Pierce Johnson), filed concurrently herewith, there is described an improved coiled coil filament and method of making such that exhibits in increase in compactness and retains or exhibits an increase in structural rigidity while exhibiting minimal sag when the filament is incorporated into an incandescent lamp. This Application is assigned to the same assignee as the instant invention. U.S. Ser. No. 742,838, filed June 10, 1985, entitled "High Performance Filament for High Voltage Low Wattage Incandescent Lamps," assigned to the assignee hereof, contains related subject matter.

TECHNICAL FIELD

The present invention relates in general to reflector-type light sources and in particular to reflector-type lamps which seek to increase reflector collection efficiency.

BACKGROUND OF THE INVENTION

It is well known in the art to utilize PAR (parabolic aluminized reflector), ER (elliptical reflector) or R (reflector) lamps for general spot, downlighting or flood lighting applications. In particular, R, PAR, and ER lamps have been exceptionally popular for short to medium distance outdoor uses as well as indoor for display, decoration, accent, inspection in down lighting applications. Such lamps are manufactured by the assignee of the instant invention. Typically PAR lamps are of hardglass and include a medium skirt or the screw-type base at the rear thereof for connecting the lamp to the desired power source.

Lamps of the PAR variety typically include a lens that may be partially or substantially totally covered with a small semispherical protrusions which in turn may be used in combination with a stippled surface area (e.g., created by shot or sand blasting) or the stippling may be used alone. The beam produced by a PAR lamp is typically of substantially conical configuration and provides a substantially round pattern. This pattern changes to being oval or elliptical should the lamp be aimed at an acute angle with the light receiving surface.

One of the problems faced by manufacturers of reflector-type lamps has been to increase the candle power by proposing several reflector and lens designs to utilize stray light that is emitted from the particular light source utilized. "Light source" may be defined as a filament or a tungsten halogen capsule or a high intensity discharge tube. With respect to the use of an incandescent filament or lamp as the light source, there is a significant increase in stray light as the length of the coiled filament increases and less light passes through the central angular region of the reflector. The problem becomes more enhanced where higher wattages are desired, due to the fact that the overall filament length increases with wattage and mounting arrangements for such filaments become more complex making it much more difficult to control the light that passes through the central angular region. This in turn requires the design of more complex reflector and lens configurations in order to effectively reflect stray light into the main beam of the reflector-type lamp thereby trying to increase the candle power of a lamp for a particular wattage and voltage.

It is believed, therefore, that there is a need for a reflector-type lamp design that reduces focus loss and improves collection efficiency in order to increase candlepower in a lamp for a particular wattage, voltage and efficacy. The increase in collection efficiency can lead to simpler reflector and lens designs which would constitute a significant advancement in the art.

SUMMARY OF THE INVENTION

Therefore, it is a primary object of this invention to provide an improved reflector-type lamp that is more efficient and utilizes simpler reflector and lens designs since stray light is reduced and channeled into the central angular region of the reflector where it can be more easily controlled and result in an increase in candlepower.

In accordance with one aspect of the instant invention, there is provided a reflector-type electric lamp having reduced focus loss including a reflector member having a central angular region and a light source disposed within the reflector member. The improvement in the reflector-type electric lamp directed primarily to the light source which comprises a hermetically sealed light transmissive envelope, means for structurally and electrically mounting a filament within the envelope and a refractory metal coiled coil filament electrically coupled to and supported by means for mounting wherein the primary winding diameter $D_1$ and the secondary winding diameter $D_2$ of the filament are determined by: $D_1=d(A+2)$ and $D_2=D_1(B+2)$ wherein: d=the filament wire diameter and $A \geqq 1.70$ and $A \leqq 4.00$, where $B \geqq A$. The compactness of the filament provides for reduced focus loss and improved reflector collection efficiency since the light from the filament is channeled into the central angular region of the reflector member.

In accordance with another aspect of the present invention, there is provided a method of reducing focus loss and increasing reflector collection efficiency in a reflector-type lamp, the lamp having a reflector member, a light source disposed within the reflector member and a lens member adjacent to the reflector member. The method comprises the steps of providing a strand of fibrous filament wire having a particular length L and diameter d for a particular wattage, voltage and efficacy. The filament wire is then wound around primary mandrel having a diameter $M_1$ determined by $M_1=A(d)$, to provide a primary coil, wherein $A \geqq 1.70$ and $A \leqq 4.00$. The primary coil is then wound around a secondary mandrel having a secondary mandrel diameter $M_2$ determined by $M_2=B(M_1+2d)$, to produce a coiled coil configuration, where $B \geqq A$. The method further includes removing substantially all of the core of the coiled coil filament; mounting the filament within an envelope to form the light source, and disposing the light source within the central angular region of the reflector member.

BEST MODE FOR CARRYING OUT THE INVENTION

For a better understanding of the present invention together other and further objects, advantages and capabilities thereof, reference is made to the following disclosure and appended claims in connection with the above described drawings.

Figure 1:
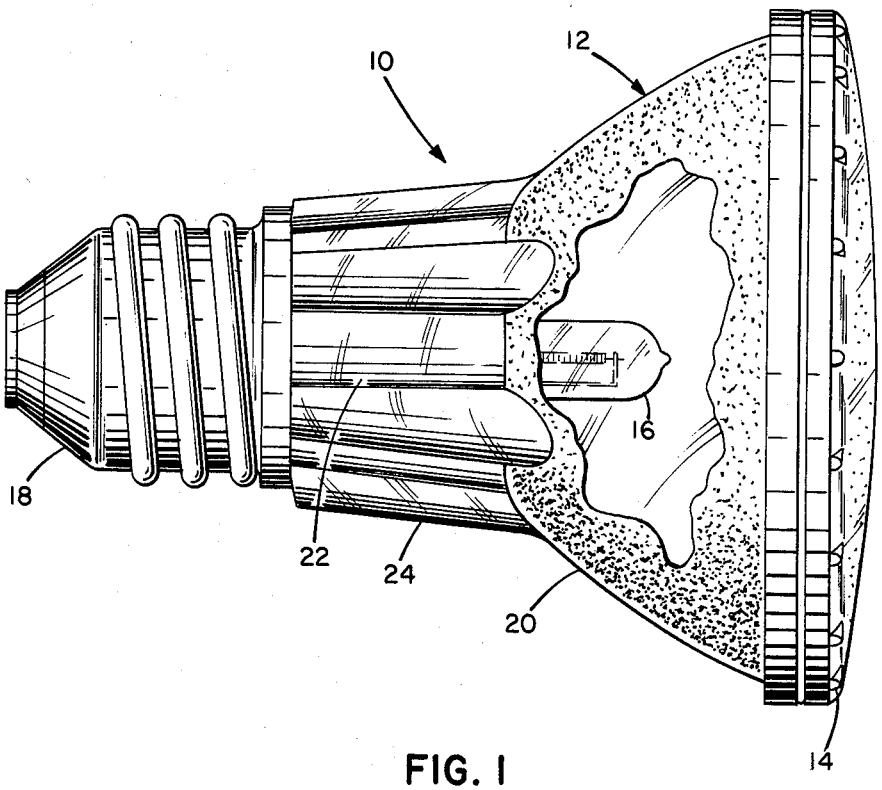
FIG. 1 is a side view of a reflector-type electric lamp, a portion of which is sectioned to illustrate the light source therein, constructed in accordance with the principles of the present invention.

With reference now to the drawings, there is shown in FIG. 1 a reflector-type electric lamp 10 that includes a reflector member 12 a lens member 14, a light source 16 disposed therein and a base 18. Reflector 12 and lens 14 can be joined by an adhesive, such as an epoxy resin, or can be flame sealed together. Lens member 14 typically has a slightly convex outer face and an optical prescription provided on its inner surface. Reflector member 14 is comprised of a parabolic section 20, that includes a light reflective coating typically comprised of aluminum or silver, and a second substantially cylindrical section 22 (which may also be reflective). Second cylindrical portion 22 has on its external surface protruding fins 24 which extend from the base of parabolic section 20 to the rear of reflective member 12; protruding fins 24 are disposed circumferentially about second cylindrical section 22. Reflector 12 is preferably a parabolic reflector but it can also be an elliptical reflector.

Electric lamp 10 has a light source 16 therein which, in the preferred embodiment, is a tungsten halogen capsule having a envelope containing an inert gas fill and a halogen disposed therein. Capsule 16 is disposed within and substantially surrounded by reflector 12 as well as being substantially perpendicular to lens 14. Capsule 16 is also attached to and supported by a mount that is fastened to reflector 12. Lamp 10 may also include rectifying means, such as a diode, and a fuse wire (which are not shown) coupled in series with capsule 16 and base 18.

Figure 2:
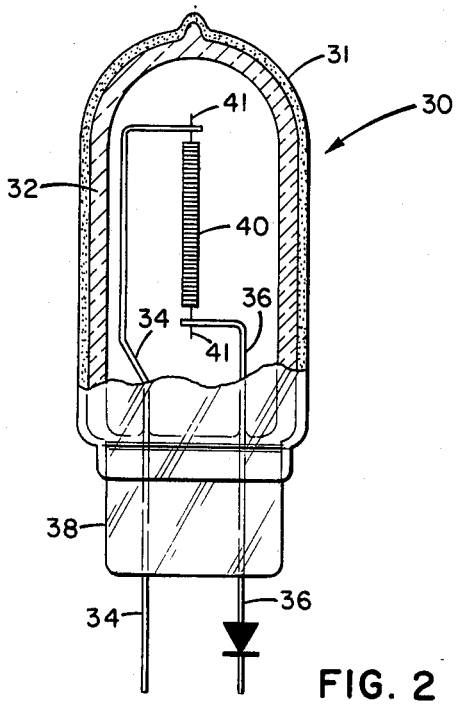
FIG. 2 illustrates one embodiment of an incandescent lamp, particularly one of the tungsten halogen variety, having a filament configuration which reduces stray light in a reflector-type lamp.

Referring now to FIG. 2, there is illustrated an example of an incandescent lamp 30, in this particular embodiment being of the tungsten halogen variety, which utilizes a compact filament configuration that reduces stray light in a reflector-type lamp. The filament wire utilized may be of the fine wire variety which is defined to be a filament wire having a diameter of about 4.5 mils or less. Lamp 30 has a tubular envelope 32, made of a suitable light transmissive material such as aluminosilicate glass which may have reflective coating 33 on an exterior surface thereof. A pair of lead in wires 34 and 36, portions of which serve as mounting means, are press sealed in envelope 32 at press seal 38. Lead in wires 34 and 36 can be formed from molybdenum, which will form a relatively strain free hermetic seal with glass envelope 32. A refractory metal (such as tungsten) coiled coil filament 40 with legs 41, is disposed within envelope 32 and is attached to the internal ends of lead in wires 34 and 36. In this particular embodiment, envelope 32 is filled with a fill gas comprising an inert gas and a halogen or halide. Suitable examples of such an inert gas include argon or krypton or xenon and nitrogen. The halogen or halide additive, which is in its gaseous state under the heat of lamp operation or may be incorporated as part of the gaseous compound, functions to reduce the coloration of the lamp envelope.

Figure 3:
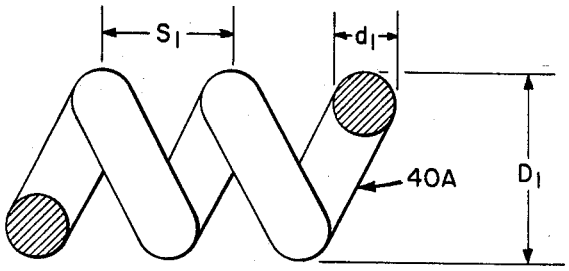
FIG. 3 illustrates a filament wire which was wound to form a coiled filament.
Figure 4:
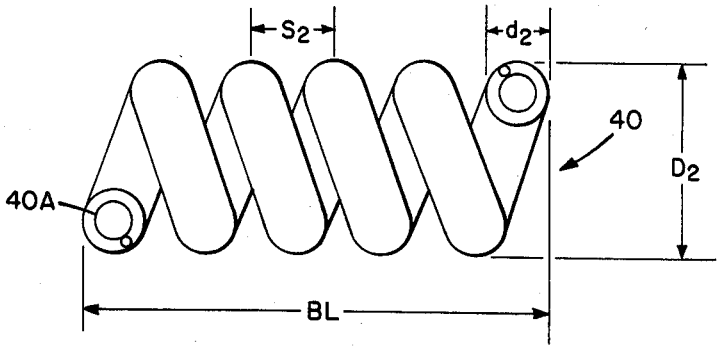
FIG. 4 illustrates a filament wire which was wound to form a coiled coil filament.

FIGS. 3 and 4 illustrate enlarged views of tungsten filament 40 and its coiled coil stages, respectively. Each stage has pitch or percent pitch, which is equal to S, the center to center spacing of the turns, divided by d the diameter of the wire or coil, multiplied by 100. Specifically, FIG. 3 illustrates the primary pitch of filament 40A having center to center spacing of $S_1$, wire diameter $d_1$ and outer diameter $D_1$. In the present invention, the primary pitch $P_1=S_1/d_1$ and the secondary pitch $P_2=S_2/d_2$ (NOTE: $d_2=D_1$) have values that do not exceed about 1.70 (or 170%). In FIG. 4, $S_2$ is the center to center spacing of the coiled coil filament, $d_2$ (NOTE: $d_2=D_1$) is the primary coil diameter and BL is the body length of the coiled coil filament. In the preferred embodiment, the secondary pitch of the filament is in the range of about 1.40 to about 1.60.

Figure 5:
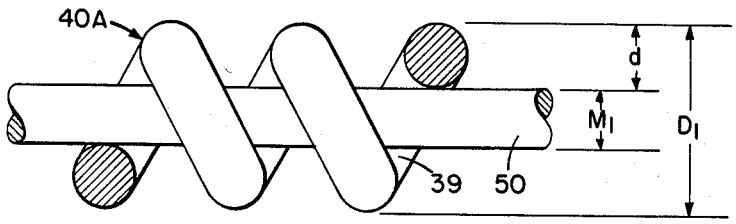
FIG. 5 illustrates a filament wire wound around a primary mandrel to form a primary coil.
Figure 6:
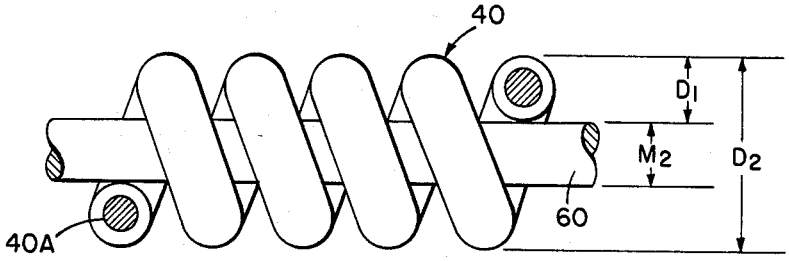
FIG. 6 illustrates a primary coil which is wound around a secondary mandrel to form the coiled coil filament.
Figure 7:
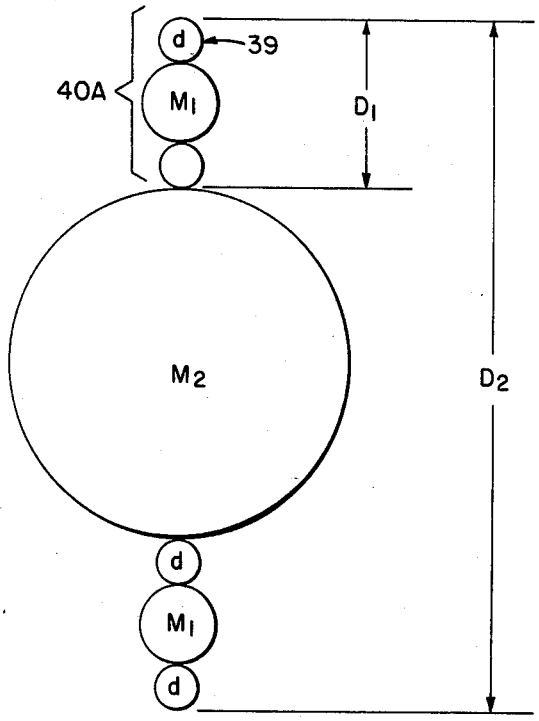
FIG. 7 illustrates the various parameters related to determining the outer diameter of a coiled coil filament of the present invention.

I have discovered, surprisingly, a method of reducing focus loss and increasing reflector collection efficiency in a reflector-type lamp, such as lamp 10. With reference to FIGS. 5–7, the method comprises the steps of providing a strand of fibrous filament wire 39 having a particular length L and diameter d for a particular wattage, voltage and efficacy and winding filament wire 39 around a primary mandrel 50 having a diameter of $M_1$ determined by: $M_1=A(d)$, to produce a primary coil 40A as illustrated in FIG. 5, wherein the values of A are expressed by the following:

$$1.70 \leqq A \leqq 4.00.$$

Referring to FIG. 6, the method further includes the step of winding primary coil 40A around a secondary mandrel 60 having a secondary mandrel diameter of $M_2$ determined by: $M_2=B(M_1+2d)$, to produce a coiled coil configuration, where $B \geqq A$. As illustrated in FIGS. 5 and 6, respectively, the primary winding diameter is equal to $D_1$ and the secondary winding diameter is equal to $D_2$. The method further includes the step of removing substantially all of the core of coiled coil filament 40, except for removing the core in legs 41 of filament 40. The core in legs 41 is preferably left intact in order to preserve the structural integrity of filament 40 when the filament is mounted within the envelope, by being crimped or attached by the legs to the mounting means, in forming light source 16. Light source 16 is then disposed within the central angular region of reflector 16.

With reference to FIG. 7, FIG. 7 illustrates outer diameter $D_2$ of the filament winding illustrated in FIG. 6, wherein the primary mandrel diameter $M_1$ is greater than the diameter of filament wire 39 and the secondary mandrel diameter $M_2$ is greater than the diameter of primary coil 40A. FIG. 7 should serve to illustrate that both the primary mandrel ratio, A, and secondary mandrel ratio, B, are greater than 1 and that the secondary mandrel ratio (i.e. $B=M_2/D_2$) is greater than the primary mandrel ratio (i.e. $A=M_1/d$),
wherein $1.70 \leqq A \leqq 4.00$ and $B \geqq A$.

To illustrate the improvement in coil or filament compactness through the use of larger mandrel ratios, particularly where the secondary mandrel ratio is greater than the primary mandrel ratio, two lamps having a visible difference in value and wattage and voltage will be used: a 105 watt lamp operated at 245 volts and 35 watt lamp operated at 84 volts. Each example will illustrate first a filament which is wound using low mandrel ratios, which was thought to be the preferred method of developing a filament which exhibits a high degree of structural rigidity but instead the rigidity is between the supported portions of the filament. When subjected to shock, the long filaments tend to vibrate excessively. This is due in part to their length and to the fact that these filaments are heated less uniformly due to the closer or smaller inner pitch that results from small mandrel ratios. Another example will then follow of the improved method of winding the filament with the use of larger values of mandrel ratios in order to chieve a high degree of compactness and thereby channel the light emitted therefrom into the central angular region of the reflector of the lamp.

| 105 WATTS/245 VOLTS | | |
|---|---|---|
| STARTING WIRE | $\frac{\text{Length}}{\text{Diameter}}$ (L/d) = 22.379 | |
| | SAMPLE WINDING | IMPROVED WINDING |
| PRIMARY MANDREL RATIO (A) | 1.40 | 2.00 |
| SECONDARY MANDREL RATIO (B) | 1.40 | 3.00 |
| FACTOR | 346 | 600 |
| $BL/D_2$ | 65:1 | 37:1 |

| 35 WATTS/84 VOLTS | | |
|---|---|---|
| STARTING WIRE | $\frac{\text{Length}}{\text{Diameter}}$ (L/d) = 8342 | |
| | SAMPLE WINDING | IMPROVED WINDING |
| A | 1.40 | 2.00 |
| B | 1.40 | 3.00 |
| FACTOR | 346 | 600 |
| $BL/D_2$ | 24:1 | 14:1 |

where:

$$\frac{BL}{D_2} = \frac{(L/d)}{30(A+2)(B+2)} = \frac{(L/d)}{(\text{Factor})}$$

BL = Body Length
$D_2$ = Outer Diameter

Referring to the 105 watt/245 volt lamp, it is noted, first of all, that such a lamp will utilize an extremely long wire of thin diameter, as exhibited by the high value obtained from the ratio of length to wire diameter (L/d)), therefore, optimum winding of such a wire will be extremely important in such a lamp. In the sample winding where the mandrel ratios are low, the resulting body length (BL) to outer diameter ($D_2$) ratio is about 65:1; this results in a long flimsy filament which will ultimately require at least one or more additional filament supports to support such a filament within a small incandescent lamp envelope. The improved winding, on the other hand, utilizes larger mandrel ratios, particularly a secondary mandrel ratio that is larger than a primary mandrel ratio, which results in a body length to outer diameter ratio of about 37:1. Illustratively, the improved filament design is much more compact and, depending on the type of mounting scheme, probably would require no extra filament supports or at least less supports than in the sample winding. Referring to the 35 watt/84 volt filament example, similar results are exhibited in that in the improved winding there is a reduction in the body length to outer diameter ratio which creates a more compact filament design. In each of the above examples, compacting is achieved by greater mandrel ratios and the upper limit in the mandrel ratio values is determined by the body length (BL) of the ultimate filament design being greater than or equal to the outer diameter ($D_2$) of the resulting filament.

A reflector type lamp having a reduction in focus loss and in reflector collection efficiency includes, among other things, a light source having a filament design that has a primary winding diameter, $D_1$, and the secondary winding diameter, $D_2$, where $D_1=d(A+2)$ and $D_2=D_1(B+2)$ wherein d is equal to the filament wire diameter and $$1.70 \leqq A \leqq 4.00 \text{ and } B \geqq A.$$

Due to the compactness of such a filament within the light source, more of the light emitted therefrom is channeled into the central angular region of the reflector, which in turn results in an increase in candle power of the beam of the lamp. The following comparative test along with FIG. 7 should be illustrative in clarifying the invention.

The test was conducted with two hardglass halogen (HGH) capsules having wattages close to 45 watts and operating at a voltage of about 84 volts but having filaments of different lengths. A 0.45 inch focal length, continuous contour (no rear cup recess), aluminum, parabolic reflector was used with a PAR 38 flood lens having a center filled with a continuous pattern.

| PAR 38 FLOOD LAMPS-HIGH CAPSULES | | |
|---|---|---|
| STARTING WIRE | A 45 WATT/ 84 VOLTS | B 46.6 WATT/ 84 VOLT |
| Length(L), Diameter(d) | 334.4 mm/1.92 mils | 355.5 mm/1.96 mils |
| L/d | 6857 | 7141 |
| Envelope size | T3 | T4 |
| Primary Mandrel Ratio(A) | 1.95 | 1.78 |
| Secondary Mandrel Ratio(B) | 2.44 | 1.40 |
| Filament Length | 0.305 in (7.75 mm) | 0.520 in (13.21 mm) |
| Outer Diameter($D_2$) | 33.68 mils | 25.24 mils |
| Shrink Factor | 43.15 | 26.91 |
| $BL/D_2$ | 9.1:1 | 20.6:1 |
| Efficiency of Utilization (Reflector) | 67% | 62% |
| Candle Power(CP) (of capsule) | 900 lumens | 790 lumens |

Figure 8:
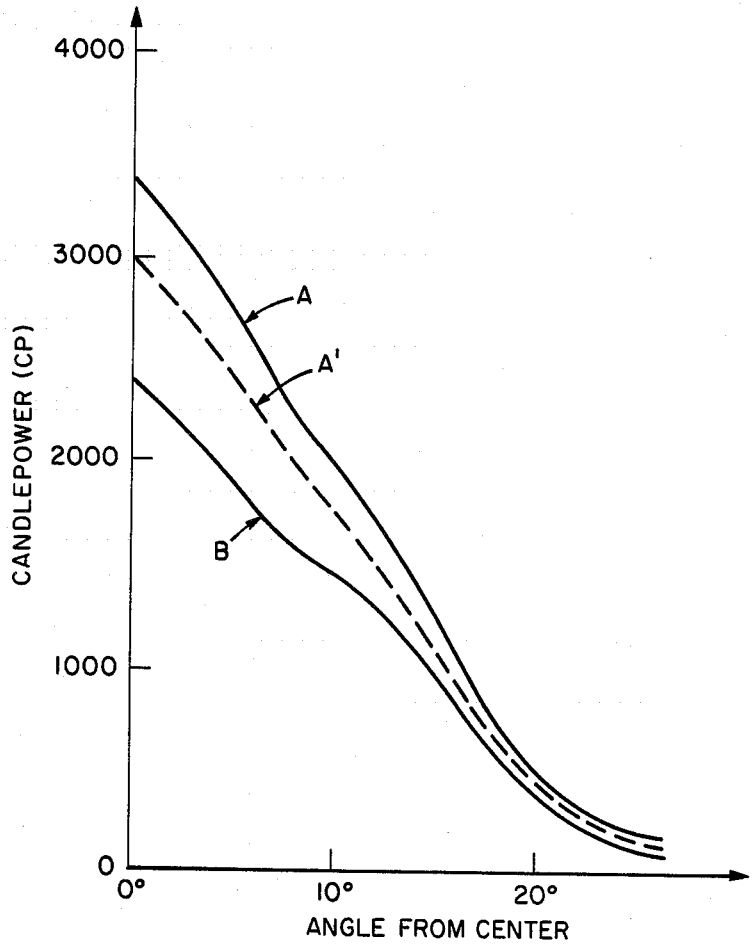
FIG. 8 is a graph that illustrates the plot of candle power of two lamps having filaments of different lengths for similar wattages.

The candlepower versus angle from center of the two lamps are shown as A and B in FIG. 8. Lamp A had a beam angle of about 24° and flood angle of about 41°, while lamp B had a beam angle of about 26° and a flood angle of about 48°. Curve A (45 watt) is normalized as A' (dotted line) to adjust it down to the capsule lumens of the longer filament (46.6 watts), Curve B. Without the lens, the longer filament gave a minimum beam size of 40° while the shorter filament gave a minimum beam size of 27° degrees. These were the relatively sharp visual edges when adjusted to minimum beam size. The longer filament produces more spread into the tails of the pattern and consequently has a lower efficiency of utilization, 62% compared to 67% for the shortest filament. This illustrates the advantage of improved collection for the shorter, more compact filament design of the light source.

The aforementioned example illustrates that in designing filament configurations for reflector-type lamp applications it is preferable to utilize a filament design that evenly spreads out the light energy throughout the central angular region, while maintaining a reasonable amount of compactness, in order to simplify the task of shaping the light emitted from the lamp with an appropriate lens. A long filament (low mandrel ratios) on the other hand spreads the light out too much, beyond the desired central region, such that portions of the reflector will be hit which will greatly disperse the light, making it much more difficult to shape the beam with a lens. A filament design that has a small diameter also tends to have a hot spot in the middle which creates a bright spot in the middle of the filament that makes it difficult to dispense the light effectively with a lens.

With respect to lamps designing reflector type lamps for operation at high voltages, especially for overseas operation at 225 and 245 volts, such lamps typically require starting off with extremely long filament wires (as illustrated earlier in the specification). In addition, filaments designed to operate at line voltage such as 120 or 130 volts also require starting with a long filament wire. The improved method for reducing focus loss and improving collection efficiency will provide for winding a filament wire into a compact coil which is especially useful for these applications and can lead to enhanced operation at high voltages since typical winding techniques have lead to extremely long filaments requiring larger envelopes, more complex mounting arrangements and a greater dispersion of light. Furthermore, the aforementioned filament design can also lead to operation without voltage reducing or rectifying means (e.g. a diode) which eliminates the modulation of the light and power fluctuations that result from the use of such rectifying means. Elimination of the rectifying means is particularly important in the 225 to 245 volt range since the small filament mass leads to greater thermal fluctuations and useful where small reflector lamp designs are sought due to the heat generated by the lamp capsule that the rectifier is exposed to.

In the past, filament sag was reduced and compactness achieved by lowering the voltage requirement of the lamp so that a shorter, larger diameter filament wire could be used. The shorter, thicker wire has allowed for an increase in the mandrel ratios in order to achieve compactness, however, transformers were now necessary to lower the line voltage. The teachings of the present invention has provided the ability to design compact high voltage filaments that lead to a simplification in reflector lamp fixture design and ultimately lower costs due to the elimination of a transformer (or voltage reducing means) in some fixtures. The more compact filament design of the present invention will also lead to an increase in structural rigidity and allows for smaller capsule design and (and possibly smaller reflector lamps) for high pressure tungsten halogen lamps of various wattage and voltage values that lead to lower capsule energy and improved contaiment due to possible lamp failures during lamp arc out. This leads to lower material costs for glass, fill gas, etc. The filament design and method for making such of the present invention is applicable to lower wattage lamps utilizing a hard glass envelope and may be applied to high wattage lamps utilizing high temperature materials for the envelope such as quartz.

While there have been shown what are at present considered to be preferred embodiments of the intention, it will be apparent to those skilled in the art that various changes and modifications can be made without departing from the scope of the invention as defined by the appended claims.

What is claimed is:

1. A reflector-type electric lamp having reduced focus loss including a reflector member, having a central angular region, a light source disposed within said reflector member, the improvement wherein said light source comprises:

a hermetically sealed light transmissive envelope;

means for structurally and electrically mounting a filament within said envelope; and a refractory metal coiled coil filament electrically coupled to and supported by said means for mounting wherein the primary winding diameter $D_1$ and the secondary winding diameter $D_2$ of said filament are:

$$D_1 = d(A + 2) \quad \text{and}$$

$$D_2 = D_1(B + 2)$$

wherein:

$d$ = the filament wire diameter $1.70 \leqq A \leqq 4.00 \; B \geqq A$ such that the compactness of said filament provides for reduced focus loss and improved reflector collection efficiency since the light from said filament is channeled into said central angular region of said reflector member.

2. The lamp according to claim 1 wherein said filament has a primary pitch ratio and a secondary pitch ratio not exceeding about 1.70.

3. The lamp according to claim 2 wherein said secondary pitch of said filament is in the range of about 1.40 to about 1.60.

4. The lamp according to claim 2 wherein said means for mounting said filament of said light source is comprised of at least two lead wires.

5. The lamp according to claim 1 wherein the wire diameter of said coiled coil filament is about 4.5 mils or less.

6. The lamp according to claim 1 wherein said envelope of said light source includes a fill gas having a halogen or halide as part thereof.

7. The lamp according to claim 6 wherein said means for mounting said filament includes a pair of lead-in wires press sealed in said envelope and extending therefrom.

8. The lamp according to claim 7 wherein said lamp further includes rectifying means electrically coupled to one of said lead-in wires, in series with said filament, and coupled to a voltage source thereby reducing the voltage across said filament.

9. The lamp according to claim 6 wherein said light source envelope includes an infrared reflective coating such that infrared light is reflected back to said filament.

10. The lamp according to claim 1 wherein said filament is substantially coreless except for the legs of said filament.

11. The lamp according to claim 1 wherein said light source envelope includes an infrared reflective coating such that infrared light is reflected back to said filament.

12. The lamp according to claim 1 wherein said reflector member is an aluminized parabolic reflector.

13. The lamp according to claim 1 wherein said reflector member is an elliptical reflector.

14. A method of reducing focus loss and increasing reflector collection efficiency in a reflector type lamp, said lamp having a reflector member, a light source disposed within said reflector member and a lens member adjacent said reflector member, said method comprising the steps of:

providing a strand of fibrous filament wire having a particular length L and diameter d for a particular wattage, voltage and efficacy;

winding said filament wire around a primary mandrel having a diameter $M_1$, determined by $M_1=A(d)$, to produce a primary coil, wherein $1.70 \leqq A \leqq 4.00$;

winding said primary coil around a secondary mandrel having a secondary mandrel diameter $M_2$ determined by $M_2=B(M_1+2d)$, to produce a coiled coil configuration, where $B \geqq A$;

removing substantially all of the core of said coiled coil filament;

mounting said filament axially within the longitudinal axis of an envelope to form said light source; and disposing said light source within the central angular region of said reflector member.

* * * * *